US008272624B1

(12) United States Patent
Frazier

(10) Patent No.: US 8,272,624 B1
(45) Date of Patent: Sep. 25, 2012

(54) FENCE ENGAGEABLE WEED BARRIER SYSTEM

(76) Inventor: Charles R. Frazier, Delray Beach, FL (US)

( * ) Notice: Subject to any disclaimer, the term of this patent is extended or adjusted under 35 U.S.C. 154(b) by 292 days.

(21) Appl. No.: 12/722,326

(22) Filed: Mar. 11, 2010

(51) Int. Cl.
*E04H 17/02* (2006.01)

(52) U.S. Cl. ..... 256/32; 256/1

(58) Field of Classification Search ..... 256/1, 19, 256/24, 32; 47/32, 33; 52/102
See application file for complete search history.

(56) References Cited

U.S. PATENT DOCUMENTS

| | | | | |
|---|---|---|---|---|
| 2,842,344 | A * | 7/1958 | Todd | 256/24 |
| 3,495,352 | A | 2/1970 | Sbare | |
| 3,704,004 | A * | 11/1972 | Carter, Jr. | 256/1 |
| 3,419,624 | A | 1/1973 | Niemann | |
| 3,713,624 | A * | 1/1973 | Niemann | 256/32 |
| 3,768,780 | A | 10/1973 | Cowles et al. | |
| 3,782,680 | A * | 1/1974 | Hopkins | 249/188 |
| 3,945,747 | A | 3/1976 | Cruz | |
| 4,903,947 | A * | 2/1990 | Groves | 256/32 |
| 4,907,783 | A * | 3/1990 | Fisk et al. | 256/32 |
| D316,951 | S | 5/1991 | Groves | |
| 5,039,065 | A * | 8/1991 | Denton | 256/1 |
| 5,178,369 | A * | 1/1993 | Syx | 256/32 |
| D343,774 | S | 2/1994 | Cox et al. | |
| 5,328,156 | A * | 7/1994 | Hoke | 256/32 |
| 6,561,491 | B2 | 5/2003 | Thompson et al. | |
| 6,837,487 | B1 * | 1/2005 | Oden et al. | 256/1 |
| 6,931,798 | B1 * | 8/2005 | Pocai | 52/102 |
| 7,004,458 | B1 * | 2/2006 | Grubba et al. | 256/1 |
| 2002/0125465 | A1 | 9/2002 | Goodson | |
| 2005/0184281 | A1 | 8/2005 | Bryan | |

* cited by examiner

*Primary Examiner* — Michael P Ferguson

(57) ABSTRACT

A fence engageable weed barrier system includes a fence that is mounted in and extends upwardly from the from a ground surface. The fence includes a fence section comprising at least one post and a dividing wall attached to and extending laterally away from the at least one post. Each of a plurality of primary barriers is positioned beneath the fence section and receives a bottom edge of the dividing wall to prevent weed growth beneath the fence section. Each of the primary barriers includes a base wall that has a top side a front edge and a back edge. A back wall is attached to and extends upwardly from the back edge. A front wall is attached to and extends upwardly from the front edge. A dividing wall receiving space is defined between the front and back walls and receives the bottom edge of the dividing wall.

10 Claims, 6 Drawing Sheets

FENCE ENGAGEABLE WEED BARRIER SYSTEM

BACKGROUND OF THE DISCLOSURE

Field of the Disclosure

The disclosure relates to weed barrier devices and more particularly pertains to a new weed barrier device for preventing weed, grass and other plant growth adjacent to and below a fence.

SUMMARY OF THE DISCLOSURE

An embodiment of the disclosure meets the needs presented above by generally comprising a fence that is mounted in and extends upwardly from the from a ground surface. The fence includes a fence section comprising at least one post and a dividing wall attached to and extending laterally away from the at least one post. Each of a plurality of primary barriers is positioned beneath the fence section and receives a bottom edge of the dividing wall to prevent weed growth beneath the fence section. Each of the primary barriers includes a base wall that has a top side, a bottom side, a front edge, a back edge, a first lateral edge and a second lateral edge. The base wall is elongated from the first lateral edge to the second lateral edge. The base wall is positioned on the ground surface between the dividing wall and the ground surface. A back wall is attached to and extends upwardly from the back edge of the base wall. The back wall is coextensive with the back edge and is orientated perpendicular to the base wall. A front wall is attached to and extends upwardly from the front edge. The front wall is coextensive with the back edge. A dividing wall receiving space is defined between the front and back walls and receives the bottom edge of the dividing wall. The front wall is angled toward the back wall such that an angle between the base wall and the front wall is between 50° and 80°.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
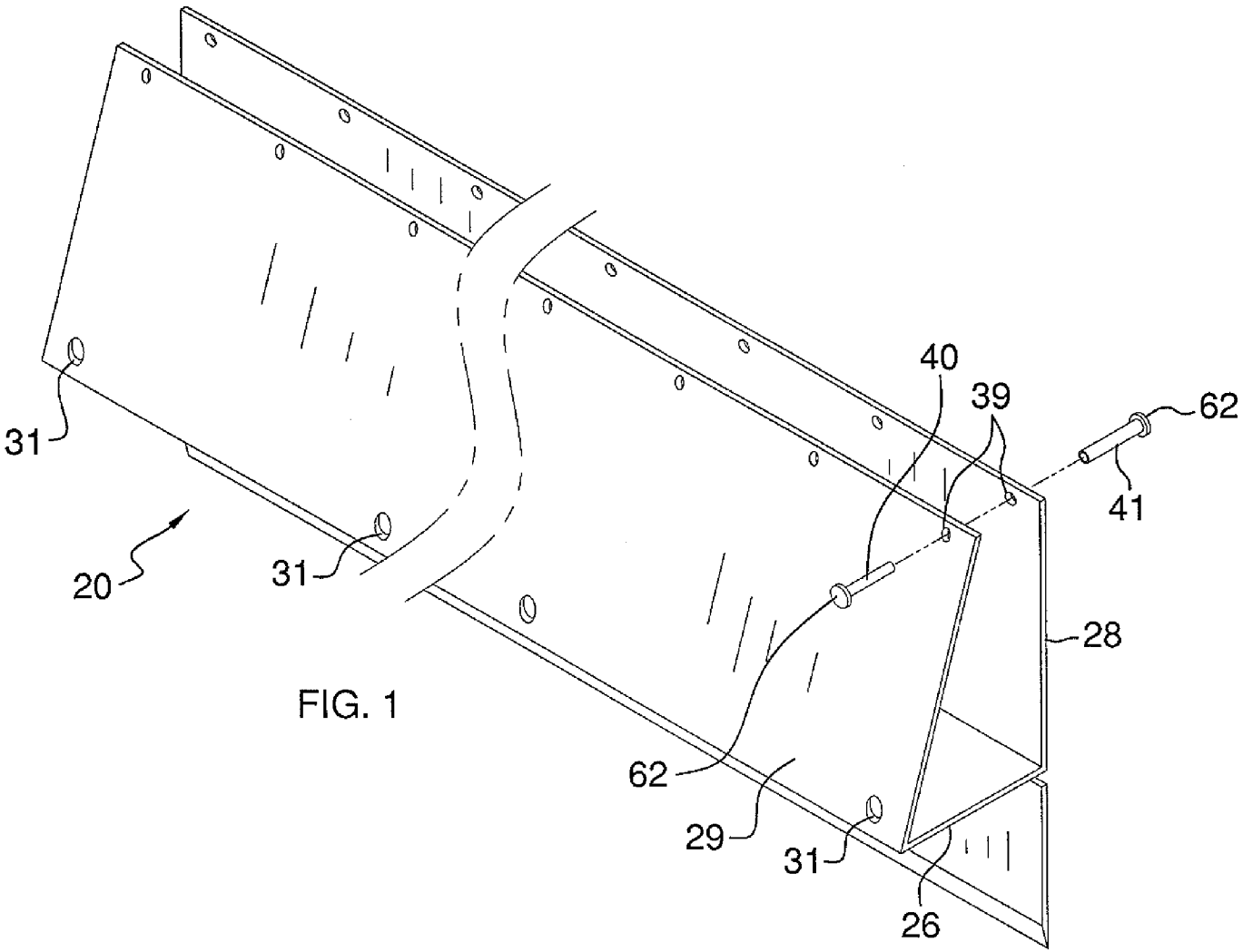
FIG. 1 is a top perspective view of a fence engageable weed barrier system according to an embodiment of the disclosure.
Figure 2:
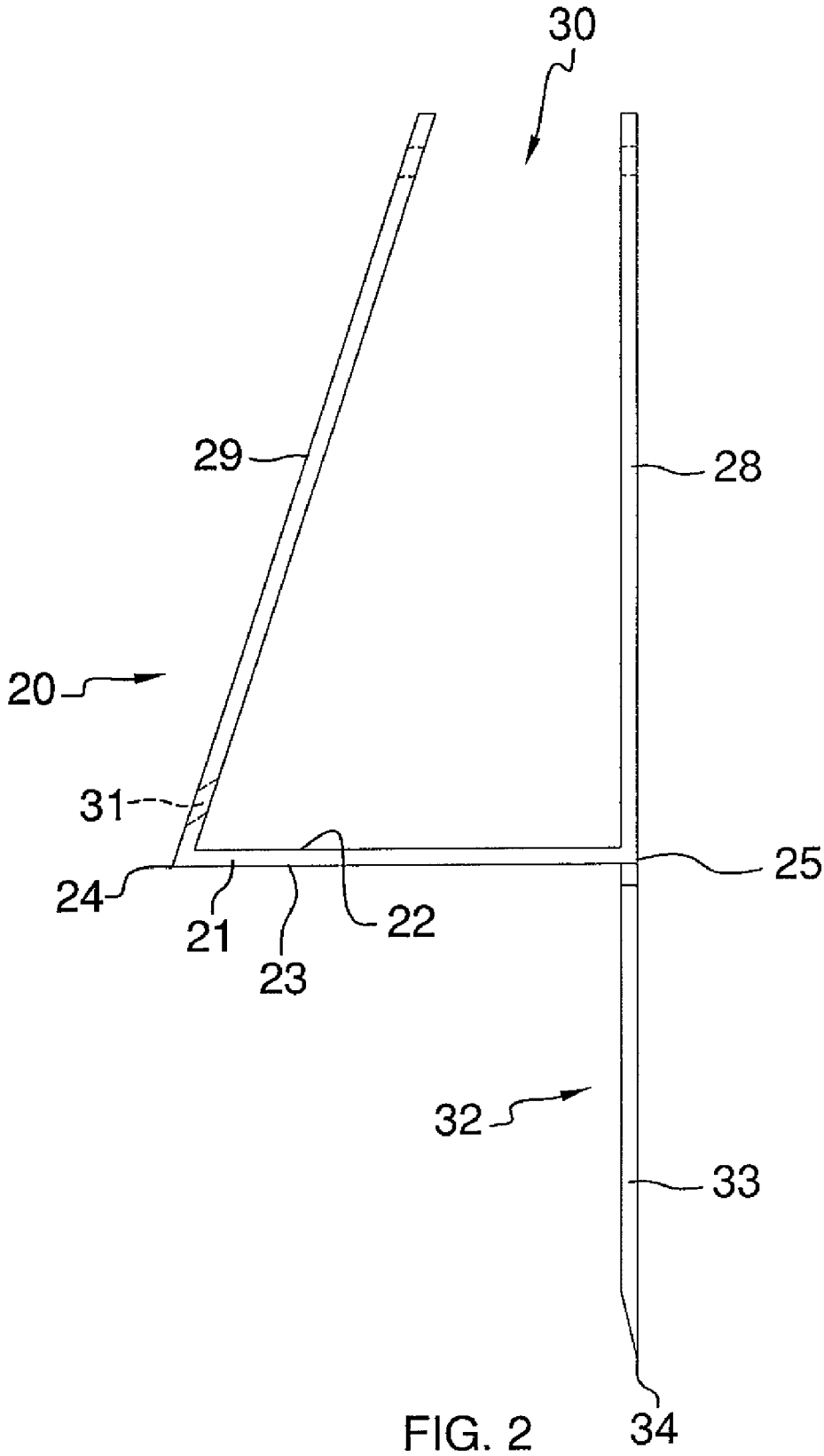
FIG. 2 is a side view of an embodiment of the disclosure.
Figure 3:
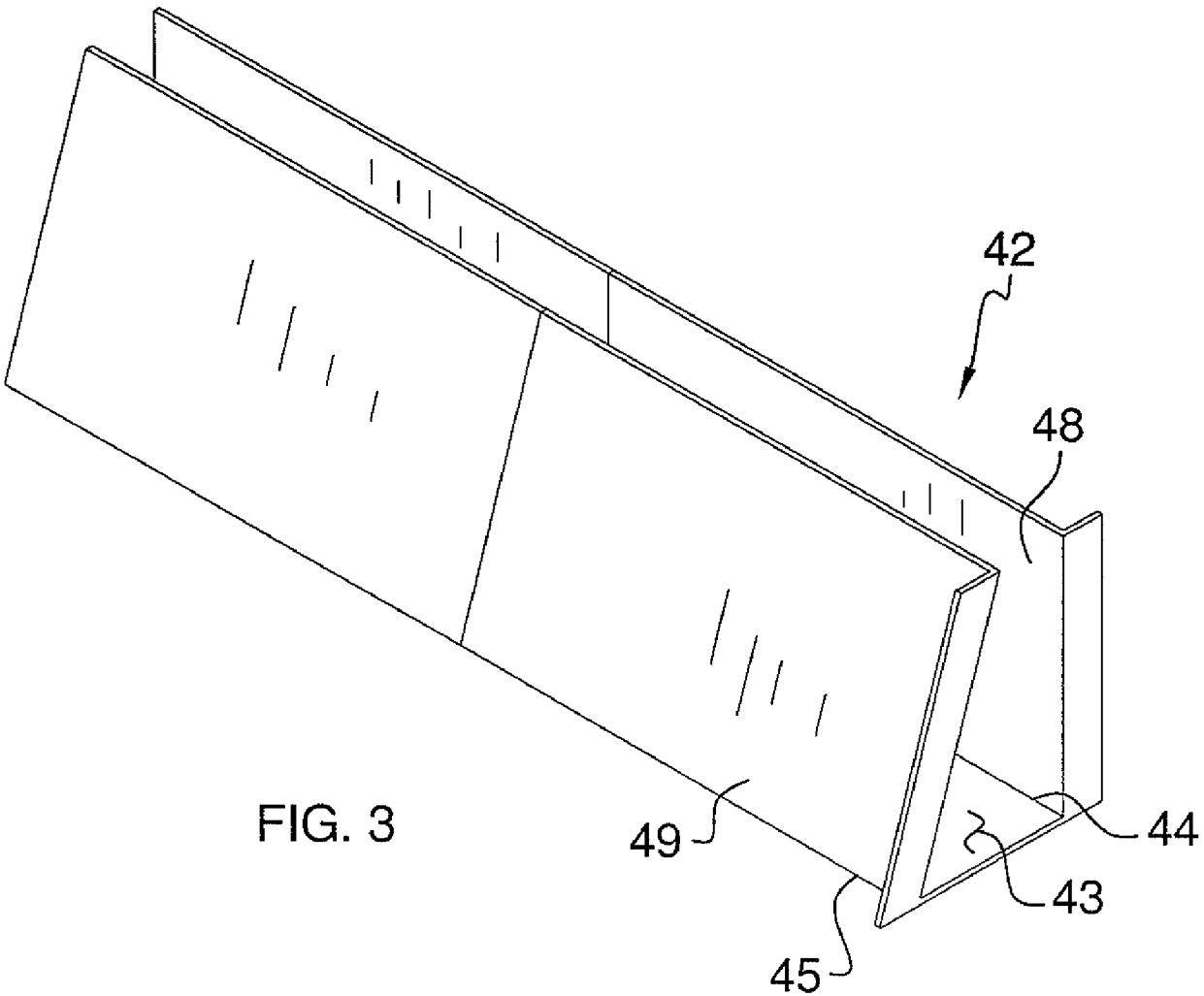
FIG. 3 is a front perspective view of a connector of an embodiment of the disclosure.
Figure 4:
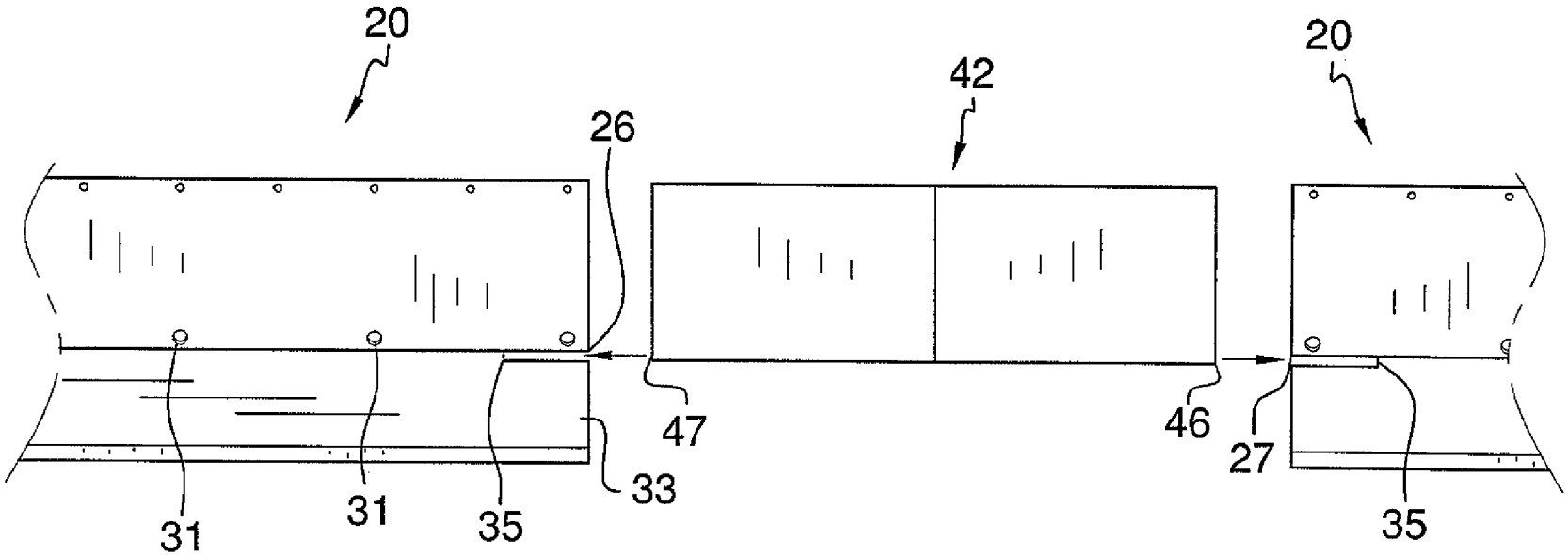
FIG. 4 is a front view of an embodiment of the disclosure.
Figure 5:
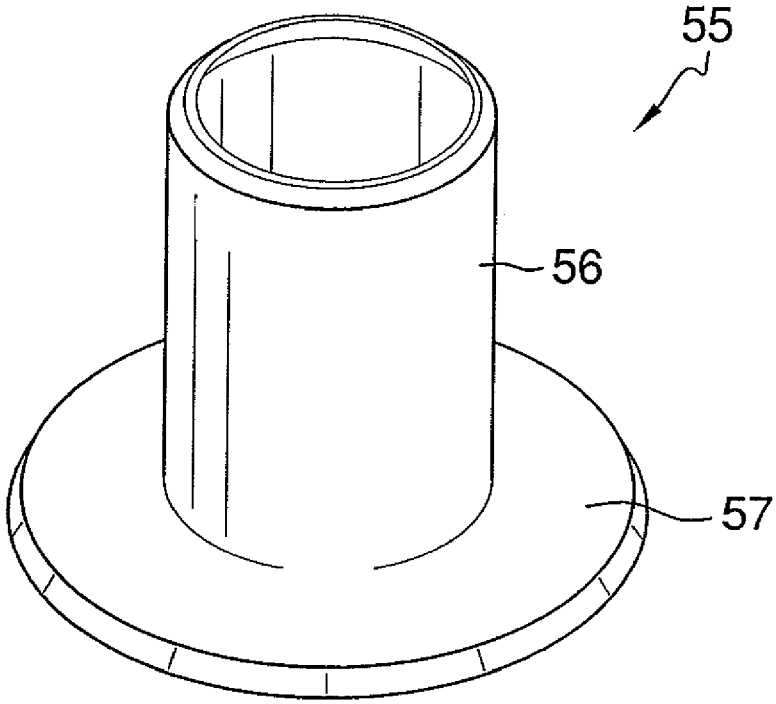
FIG. 5 is a front perspective view of a fence post covering of an embodiment of the disclosure.
Figure 6:
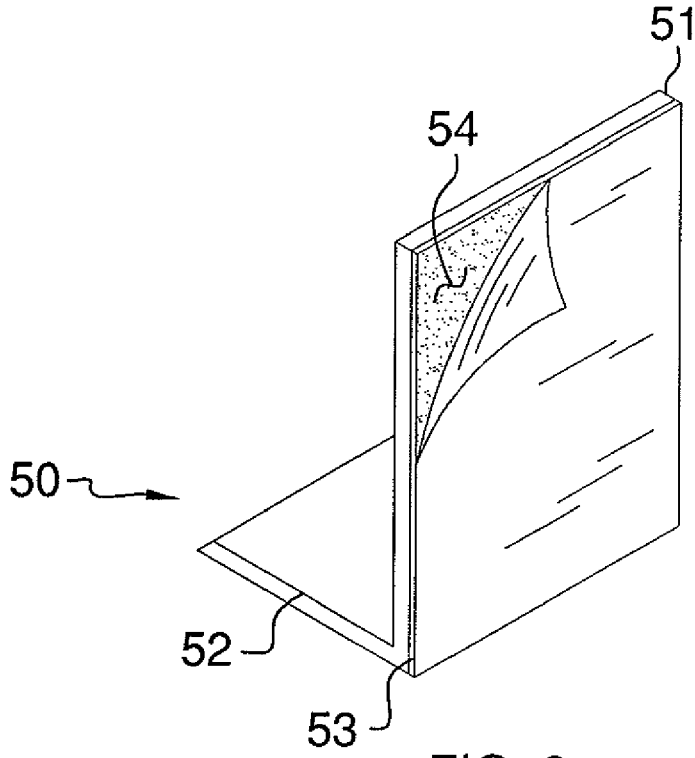
FIG. 6 is a rear perspective view of a fence post covering of an embodiment of the disclosure.

With reference now to the drawings, and in particular to FIGS. 1 through 7 thereof, a new weed barrier device embodying the principles and concepts of an embodiment of the disclosure and generally designated by the reference numeral 10 will be described.

Figure 7:
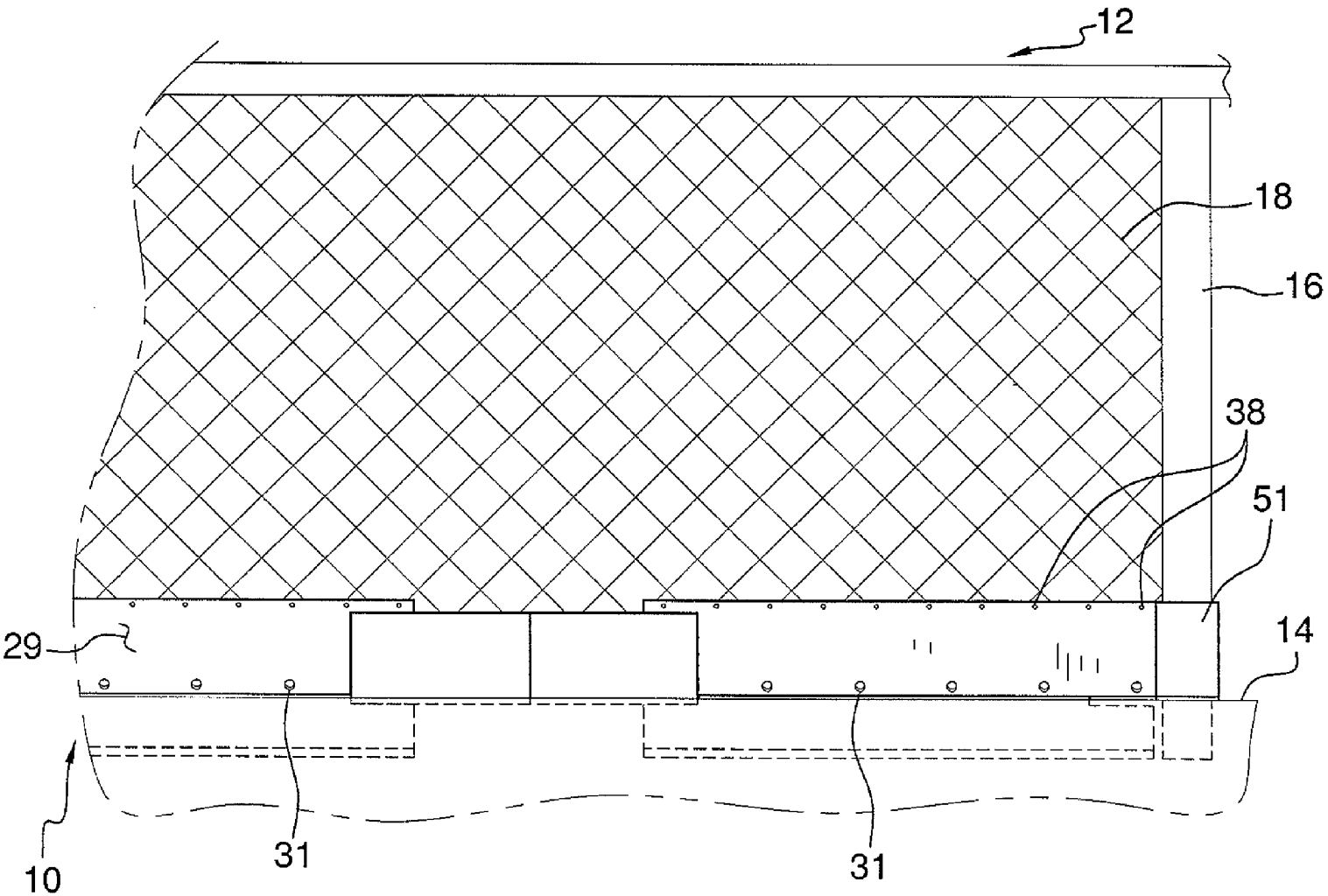
FIG. 7 is a front view of an embodiment of the disclosure.

As best illustrated in FIGS. 1 through 7, the fence engageable weed barrier system 10 generally comprises a conventional fence that is mounted in and extends upwardly from the from a ground surface 14. The fence includes a fence section 12 comprising at least one post 16 and a dividing wall 18 that is attached to and extends laterally away from the at least one post 16. The dividing wall 18 may include any type of conventional dividing material such as planks or, as shown in FIG. 7, chain link. The dividing wall 18 will typically be extended between a pair of posts 18.

A plurality of primary barriers 20 is provided. Each of the primary barriers 20 is positioned beneath the fence section 12 and receives a bottom edge of the dividing wall 18 to prevent weed growth beneath the fence section 12. Each of the primary barriers 20 includes a base wall 21 that has a top side 22, a bottom side 23, a front edge 24, a back edge 25, a first lateral edge 26 and a second lateral edge 27. The base wall 21 is elongated from the first lateral edge 26 to the second lateral edge 27 and is positioned on the ground surface 14 between the dividing wall 18 and the ground surface 14. A back wall 28 is attached to and extends upwardly from the back edge 25 of the base wall 21. The back wall 28 is coextensive with the back edge 25 and is orientated perpendicular to the base wall 21. A front wall 29 is attached to and extends upwardly from the front edge 24. The front wall 29 is coextensive with the front edge 24. A dividing wall receiving space 30 is defined between the front 29 and back 28 walls. The front wall 29 is angled toward the back wall 28 such that an angle between the base wall 21 and the front wall 29 is between 50° and 80°. The front wall 29 has a plurality of drainage apertures 31 therein positioned adjacent to the base wall. The drainage apertures 31 allow for drainage without allowing weeds to grow up through the base wall 21. If the primary barrier 20 is long enough, or the fence section 12 short enough, only one primary barrier 20 may be used per fence section 12.

Each of the primary barriers 20 further includes an anchor 32 that is attached to and extends downwardly from the base wall 21. The anchor 32 includes a plate 33 that has a bottom edge 34 tapered to a point to facilitate the extension of the anchor into the ground surface 14. The plate 33 extends along a length of the base wall 21 from the first lateral edge 26 to the second lateral edge 27. The plate 33 adjoins and is coextensive with the back edge 25. The plate 33 is orientated perpendicular to the base wall 21 and has a pair of notches therein 35. Each of the notches 35 is located at a juncture of the base wall 21 and the plate 33. One of the notches 35 extends inwardly from the first lateral edge 26 and one of the notches 35 extends inwardly from the second lateral edge 27.

A plurality of fasteners 38 is provided. Each of the primary barriers 20 has at least one of the fasteners 38 extending therethrough. The fasteners 38 extend through associated ones of the front 29 and back 28 walls and the dividing wall 18 to restrict movement of the primary barriers 20 with respect to the dividing wall 18. The fasteners 38 extend through aligned openings 39 extending through the front 29 and back 28 walls.

In particular, the fasteners 38 may include male 40 and female 41 couplers that are engageable with each other and each has a head 42 preventing its being pulled through the front 29 or back 28 walls.

A plurality of connectors 42 is also provided, though only one may be provided if only one is needed. Each of the connectors 42 is positionable between pairs of primary barriers 20 to couple two of the primary barriers 20 together. Each of the connectors 42 comprises a bottom wall 43 having a rear edge 44, a forward edge 45, a first side edge 46 and a second side edge 47. The bottom wall 43 has a greater width from the rear edge 44 to the forward edge 45 than a width of the base wall 21 from the front edge 24 to the back edge 25. A rear wall 48 is attached to and is coextensive with the rear edge 44. The rear wall 48 is perpendicular to the bottom wall 43. A forward wall 49 is attached to and is coextensive with the forward edge 45. An angle of the forward wall 48 with respect to the bottom wall 43 is approximately equal to the angle between the base wall 21 and the front wall 29. The bottom wall 43 is extendable into the notches 35 of adjacently positioned ones of the primary barriers 20, and the front 29 and back 28 walls of the adjacent ones of the primary barriers 20 are extendable between the rear 48 and forward 49 walls to couple t together and prevent a formation of a gap between the adjacent ones of the primary barriers 20.

A post covering 50 is attachable to the post 16 to cover the post 16 between the primary barriers 20. The post covering 50 includes a vertical wall 51 and a horizontal wall 52 attached to each other at a perpendicular angle and forming an L-shape. The vertical wall 51 has a rear surface 53 facing away from the horizontal wall 52. An adhesive 54 is positioned on the rear surface 53 and secures the vertical wall 51 to the post 16. Alternatively, if the system 10 is to be installed as the fence is being constructed, a secondary post barrier 55, shown in FIG. 5, may be used which includes a sleeve 56 and an outwardly extending flange 57. The sleeve 56 is simply placed on the fence post 16 and the flange 57 abutted against the ground surface 14.

In use, the primary barriers 20 are placed on the ground surface 14 and receive the fence 12 as described above and as shown in the Figures. The primary barriers 20, as well as the couplers 42 and post covering 50, prevent plant growth below the fence 12 and allow for easier trimming of grass along the fence 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A weed barrier system comprising:

a fence being mounted in and extending upwardly from said from a ground surface, said fence including a fence section comprising at least one post and a dividing wall being attached to and extending laterally away from said at least one post;

a plurality of primary barriers, each of said primary barriers being positioned beneath said fence section and receiving a bottom edge of said dividing wall to prevent weed growth beneath said fence section, each of said primary barriers including:

a base wall having a top side, a bottom side, a front edge, a back edge, a first lateral edge and a second lateral edge, said base wall being elongated from said first lateral edge to said second lateral edge, said base wall being positioned on the ground surface between said dividing wall and said ground surface;

a back wall being attached to and extending upwardly from said back edge of said base wall, said back wall being coextensive with said back edge, said back wall being orientated perpendicular to said base wall;

a front wall being attached to and extending upwardly from said front edge, said front wall being coextensive with said front edge, a dividing wall receiving space being defined between said front and back walls, said front wall being angled toward said back wall such that an angle between said base wall and said front wall is between 50° and 80°; and a plurality of connectors, each positionable between a pair of adjacent primary barriers, each said connector comprising:

a bottom wall having a rear edge and a forward edge, said bottom wall having a greater width from said rear edge to said forward edge than a width of said base wall from said front edge to said back edge;

a rear wall extending upwardly from and being coextensive with said rear edge;

a forward wall extending upwardly from and being coextensive with said forward edge;

wherein said bottom wall is positionable beneath said base walls of adjacent ones of said primary barriers, said front and back walls of said adjacent ones of said primary barriers being extendable between said rear and forward walls to couple together and prevent a formation of a gap between the adjacent ones of said primary barriers;

an anchor being attached to and extending downwardly from said base wall, said anchor including a plate said plate being orientated perpendicular to said base wall, said plate having a pair of notches therein, each of said notches being located at a juncture of said base wall and said plate, one of said notches extending inwardly from said first lateral edge and one of said notches extending inwardly from said second lateral edge; and wherein said bottom wall is extendable into notches of the adjacently positioned ones of said primary barriers.

2. The system according to claim 1, wherein said front wall of each of said primary barriers having a plurality of drainage apertures therein positioned adjacent to said base wall.

3. The system according to claim 1, wherein each of said primary barriers further includes:

an anchor being attached to and extending downwardly from said base wall, said anchor including a plate having a bottom edge being tapered to a point to facilitate the extension of said anchor into the ground surface.

4. The system according to claim 3, wherein said plate extends along a length of said base wall from said first lateral edge to said second lateral edge.

5. The system according to claim 4, wherein said plate adjoins and is coextensive with said back edge, said plate being orientated perpendicular to said base wall.

6. The system according to claim 1, further including a plurality of fasteners, each of said primary barriers having at least one of said fasteners extending therethrough.

7. The system according to claim 6, wherein said fasteners extend through associated ones of said front and back walls and said dividing wall to restrict movement of said primary barriers with respect to said dividing wall, said fasteners extending through aligned openings extending through said front and back walls.

8. The system according to claim 1, further including a post covering being attachable to said post to cover the post adjacent the ground surface, said post covering including a vertical wall and a horizontal wall attached to each other at a perpendicular angle and forming an L-shape, said vertical wall having a rear surface facing away from said horizontal wall, an adhesive being positioned on said rear surface, said adhesive securing said vertical wall to said post.

9. A weed barrier system comprising:

a fence being mounted in and extending upwardly from said from a ground surface, said fence including a fence section comprising at least one post and a dividing wall being attached to and extending laterally away from said at least one post;

a plurality of primary barriers, each of said primary barriers being positioned beneath said fence section and receiving a bottom edge of said dividing wall to prevent weed growth beneath said fence section, each of said primary barriers including;

a base wall having a top side, a bottom side, a front edge, a back edge, a first lateral edge and a second lateral edge, said base wall being elongated from said first lateral edge to said second lateral edge, said base wall being positioned on the ground surface between said dividing wall and said ground surface;

a back wall being attached to and extending upwardly from said back edge of said base wall, said back wall being coextensive with said back edge, said back wall being orientated perpendicular to said base wall;

a front wall being attached to and extending upwardly from said front edge, said front wall being coextensive with said front edge, a dividing wall receiving space being defined between said front and back walls, said front wall being angled toward said back wall such that an angle between said base wall and said front wall is between 50° and 80°;

a plurality of connectors, each of said connectors being positionable between pairs of primary barriers to couple two of said primary barriers together, each of said connectors comprising:

a bottom wall having a rear edge, a forward edge, a first side edge and a second side edge, said bottom wall having a greater width from said rear edge to said forward edge than a width of said base wall from said front edge to said back edge;

a rear wall being attached to and being coextensive with said rear edge, said rear wall being perpendicular to said bottom wall;

a forward wall being attached to and being coextensive with said forward edge, an angle of said forward wall with respect to said bottom wall being approximately equal to the angle between said base wall and said front wall;

wherein said bottom wall is positionable beneath said base walls of adjacent ones of said primary barriers, said front and back walls of said adjacent ones of said primary barriers being extendable between said rear and forward walls to couple together and prevent a formation of a gap between the adjacent ones of said primary barriers;

an anchor being attached to and extending downwardly from said base wall, said anchor including a plate having a bottom edge being tapered to a point to facilitate the extension of said anchor into the ground surface, said plate extending along a length of said base wall from said first lateral edge to said second lateral edge, said plate adjoining and being coextensive with said back edge, said plate being orientated perpendicular to said base wall, said plate having a pair of notches therein, each of said notches being located at a juncture of said base wall and said plate, one of said notches extending inwardly from said first lateral edge and one of said notches extending inwardly from said second lateral edge;

wherein said bottom wall is extendable into notches of the adjacently positioned ones of said primary barriers.

10. A weed barrier system comprising:

a fence being mounted in and extending upwardly from said from a ground surface, said fence including a fence section comprising at least one post and a dividing wall being attached to and extending laterally away from said at least one post;

a plurality of primary barriers, each of said primary barriers being positioned beneath said fence section and receiving a bottom edge of said dividing wall to prevent weed growth beneath said fence section, each of said primary barriers including:

a base wall having a top side, a bottom side, a front edge, a back edge, a first lateral edge and a second lateral edge, said base wall being elongated from said first lateral edge to said second lateral edge, said base wall being positioned on the ground surface between said dividing wall and said ground surface;

a back wall being attached to and extending upwardly from said back edge of said base wall, said back wall being coextensive with said back edge, said back wall being orientated perpendicular to said base wall;

a front wall being attached to and extending upwardly from said front edge, said front wall being coextensive with said the edge, a dividing wall receiving space being defined between said front and back walls, said front wall being angled toward said back wall such that an angle between said base wall and said front wall is between 50° and 80°, said front wall having a plurality of drainage apertures therein positioned adjacent to said base wall;

an anchor being attached to and extending downwardly from said base wall, said anchor including a plate having a bottom edge being tapered to a point to facilitate the extension of said anchor into the ground surface, said plate extending along a length of said base wall from said first lateral edge to said second lateral edge, said plate adjoining and being coextensive with said back edge, said plate being orientated perpendicular to said base wall, said plate having a pair of notches therein, each of said notches being located at a juncture of said base wall and said plate, one of said notches extending inwardly from said first lateral edge and one of said notches extending inwardly from said second lateral edge;

a plurality of fasteners, each of said primary barriers having at least one of said fasteners extending therethrough, said fasteners extending through associated ones of said front and back walls and said dividing wall to restrict movement of said primary barriers with respect to said dividing wall, said fasteners extending through aligned openings extending through said front and back walls;

a plurality of connectors, each of said connectors being positionable between pairs of primary barriers to couple two of said primary barriers together, each of said connectors comprising:

a bottom wall having a rear edge, a forward edge, a first side edge and a second side edge, said bottom wall having a greater width from said rear edge to said forward edge than a width of said base wall from said front edge to said back edge;

a rear wall being attached to and being coextensive with said rear edge, said rear wall being perpendicular to said bottom wall;

a forward wall being attached to and being coextensive with said forward edge, an angle of said forward wall with respect to said bottom wall being approximately equal to the angle between said base wall and said front wall;

wherein said bottom wall is extendable into notches of adjacently positioned ones of said primary barriers and said front and back walls of said adjacent ones of said primary barriers are extendable between said rear and forward walls to couple together and prevent a formation of a gap between the adjacent ones of said primary barriers; and a post covering being attachable to said post to cover the post adjacent the ground surface, said post covering including a vertical wall and a horizontal wall attached to each other at a perpendicular angle and forming an L-shape, said vertical wall having a rear surface facing away from said horizontal wall, an adhesive being positioned on said rear surface, said adhesive securing said vertical wall to said post.

* * * * *